US009082281B2

(12) United States Patent
Ponce

(10) Patent No.: US 9,082,281 B2
(45) Date of Patent: Jul. 14, 2015

(54) TOOL LOCATOR DEVICE AND SYSTEM

(71) Applicant: Isaac Ponce, Budd Lake, NJ (US)

(72) Inventor: Isaac Ponce, Budd Lake, NJ (US)

( * ) Notice: Subject to any disclaimer, the term of this patent is extended or adjusted under 35 U.S.C. 154(b) by 71 days.

(21) Appl. No.: 13/939,674

(22) Filed: Jul. 11, 2013

(65) Prior Publication Data

US 2014/0015672 A1 Jan. 16, 2014

Related U.S. Application Data

(60) Provisional application No. 61/670,196, filed on Jul. 11, 2012.

(51) Int. Cl.
*G08B 1/08* (2006.01)
*G08B 26/00* (2006.01)
*G08B 21/24* (2006.01)

(52) U.S. Cl.
CPC ..... *G08B 26/00* (2013.01); *G08B 21/24* (2013.01)

(58) Field of Classification Search
CPC ..... H04W 4/00; G06K 1/00
USPC ..... 340/539.32, 568.1
See application file for complete search history.

(56) References Cited

U.S. PATENT DOCUMENTS

| | | | | |
|---|---|---|---|---|
| 7,551,076 | B2 | 6/2009 | Tyroler | |
| 2002/0126010 | A1* | 9/2002 | Trimble et al. | 340/568.1 |
| 2003/0102970 | A1* | 6/2003 | Creel et al. | 340/568.1 |
| 2005/0099293 | A1* | 5/2005 | Tyroler | 340/539.32 |
| 2008/0117029 | A1* | 5/2008 | Dohrmann et al. | 340/286.02 |

* cited by examiner

*Primary Examiner* — Shirley Lu
(74) *Attorney, Agent, or Firm* — MH2 Technology Law Group, LLP

(57) ABSTRACT

A device and system for electronically tracking one or more objects, such as tools or equipment is provided. The tool locator device and system of the present invention provides an electronic checklist specially designed to keep track of a set of tools or accessories.

17 Claims, 3 Drawing Sheets

TOOL LOCATOR DEVICE AND SYSTEM

CROSS-REFERENCE TO RELATED APPLICATIONS

This application claims priority to U.S. Provisional No. 61/670,196, filed Jul. 11, 2012, and entitled "TOOL FINDER," which is herein incorporated by reference in its entirety.

FIELD

The present invention relates generally to devices and systems for locating objects. More specifically, the present invention relates to devices and systems for electronically tracking one or more objects, such as tools or equipment.

BACKGROUND

The vast majority of home improvement or repair jobs cannot be completed without the proper tools. In fact, it is not uncommon to find a fully stocked tool box or chest in the garages, sheds, and utility closets of America. Whether one should need to use pliers to loosen a stubborn screw, a hammer to secure woodwork, a wrench to access a leaky pipe, or a screwdriver to assemble an entertainment center, it is essential that the appropriate hand tool is always at the ready whenever a task presents itself. Although collecting an extensive sampling of every hand tool would result in one always being prepared, there is a drawback to such an undertaking.

Particularly, all the various sized pliers, wrenches, screwdrivers, and wire cutters, not to mention the tiny drill bits and screw tips, can quickly become lost or misplaced when removed from the tool box. Whether they have slipped between chair cushions or been absently placed in another room, furiously searching for these items can be extremely aggravating and time consuming, and can, more often than not, turn a potentially satisfying repair job into a daunting and frustrating chore. Additionally, the sheer volume of tools needed for a particular project can be daunting to manage.

The problem of locating or tracking various tools or equipment is even more relevant for repairmen or servicemen who often rely on a number of different pieces of machinery and accessories to accomplish their task. For instance, an appliance repairman, in a hurry to reach his scheduled appointment, gathers all of his tools from his truck, only to realize too late that he inadvertently forgot to grab his wrench from the last job. Not only is this scenario frustrating, but it can also be quite embarrassing for the professional. More importantly, the lost equipment represents lost time and money.

Various attempts have been made to solve problems found in tool locating devices art. For example, U.S. Publication No. 2002/0126010 to Bradley G. Trimble et al. discloses an object locating system having a control unit and one or more electronic tags that can be placed onto commonly misplaced or lost objects, such as keys, a wallet, eyeglasses, remote control device, etc. for locating these objects. The electronic tags can be activated through a telephone link to the control unit. Once activated, the tags can produce an audible signal or visual indication for indicating the location of the object being sought. However, this object locating system requires that the user call another party, such as a neighbor, friend or relative, who would then need to push a button on the phone, in order to activate the tag and initiate the audible signal. This is not only inefficient, but also time-consuming. In order for the process to work, the receiving party must be available to take the call from the user, have a phone handy, and be ready with the key code to enter into the phone. There is no guarantee that a neighbor, friend or relative is available at the exact moment the user needs to locate the glasses, wallet, or keys that is lost, nor can it be assumed that the receiving party will remember the key code either. Thus, too many independent variables are involved to ensure that each transaction goes smoothly and reliably as planned.

U.S. Publication No. 2003/0102970 to Myron Dale Creel et al. provides a storage container or toolbox with the ability to query individual objects within the toolbox to verify the presence or absence of the object. The query may be wirelessly transmitted to a control unit for processing and maintenance coordination, thereby ensuring that the tool box maintains a complete set of required objects at all times. However, the storage container would not help to locate objects from a collection of objects that do not easily fit into a single container. For example, where the objects are large equipment or tools, such as a ladder, sander, etc. this storage container would not serve the necessary function of tracking these individual objects.

U.S. Pat. No. 7,551,076 to Dan Tyroler provides an object locator system that can be integrated into existing home or business security systems. Electronic tags having a unique address or identification may be placed onto various objects, such as glasses, wallets, or even pets or small children. The object locator system allows the user to coordinate the identities as well as the physical location of the object through sensory features already present in most security systems, such as motion sensors, and activate an alarm to reveal its location. However, this object locator system is dependent upon the proper operation of the home or business security system, and would only appear to be useful for locating objects that are intended to remain within the home or business.

The aforementioned describes prior art representative of object or tool locating devices. As discussed, these object locator systems suffer from various setbacks. Thus, a need exists for an improved tool locator device and system that is not only reliable, repeatable and easy to use, but also fully operable by a single individual and is independent of other monitoring systems. Even more desirable is a tool locator device and system that is capable of tracking a series or collection of tools or equipment that are not typically transported in a single container unit or tool box.

SUMMARY

The present invention provides a device and system for electronically tracking one or more objects, such as tools or equipment. The system is reliable and easy to use, and is fully operable by a single individual. The system is independent of other monitoring systems, and does not require additional telecommunications services such as a telephone line to work. The tool locator device and system of the present invention is capable of tracking a series or collection of objects, such as for example, tools or equipment. These tools may be of the kind that would not typically be provided as a set, or transported together in a container unit or toolbox.

According to one aspect of the invention, the tool locator device and system of the present invention provides an electronic checklist specially designed to keep track of a set of tools or accessories. These tools or accessories may represent a set of tools or accessories commonly used by both do-it-yourselfers and professional tradespeople. The device and system may provide a highly visual, digitized means of ensuring that the set of tools or accessories are available together all at once for the completion of a task, are not missing or lost upon completion of this task.

In one exemplary embodiment, an object locator system is provided. The system may comprise a transmitter device comprising an electronic control circuit for producing control signals, the transmitter device having a panel display for viewing a list of objects to be tracked. One or more receiver tags comprising an electronic circuit for receiving the control signals from the transmitter device, and for transmitting a response signal to the transmitter device, each one of the receiver tags being attachable to an object from the list are also provided. The transmitter device may be configured to provide a visual or audible signal representing the presence or absence of the objects of the list relative to a predetermined distance from the transmitter device.

It is to be understood that both the foregoing general description and the following detailed description are exemplary and explanatory only and are not restrictive of the disclosure. Additional features of the disclosure will be set forth in part in the description which follows or may be learned by practice of the disclosure.

BRIEF DESCRIPTION OF THE DRAWINGS

The accompanying drawings, which are incorporated in and constitute a part of this specification, illustrate several embodiments of the disclosure and together with the description, serve to explain the principles of the disclosure.

The various embodiments of the present invention will hereinafter be described in conjunction with the appended drawings.

DESCRIPTION OF THE EMBODIMENTS

Embodiments of the present invention relate to a device and system for tracking one or more objects, such as tools or equipment. The system is reliable and easy to use, and is fully operable by a single individual. The system is independent of other monitoring systems, and does not require additional telecommunications services such as a telephone line to work. The tool locator device and system of the present invention is capable of tracking a series or collection of objects, such as for example, tools or equipment. These tools may be of the kind that would not typically be provided as a set, or transported together in a container unit or toolbox.

According to one aspect of the invention, the tool locator device and system of the present invention provides an electronic checklist specially designed to keep track of a set of tools or accessories. These tools or accessories may represent a set of tools or accessories commonly used by both do-it-yourselfers and professional tradespeople. The device and system may provide a highly visual, digitized means of ensuring that the set of tools or accessories are available together all at once for the completion of a task, are not missing or lost upon completion of this task.

Figure 1:
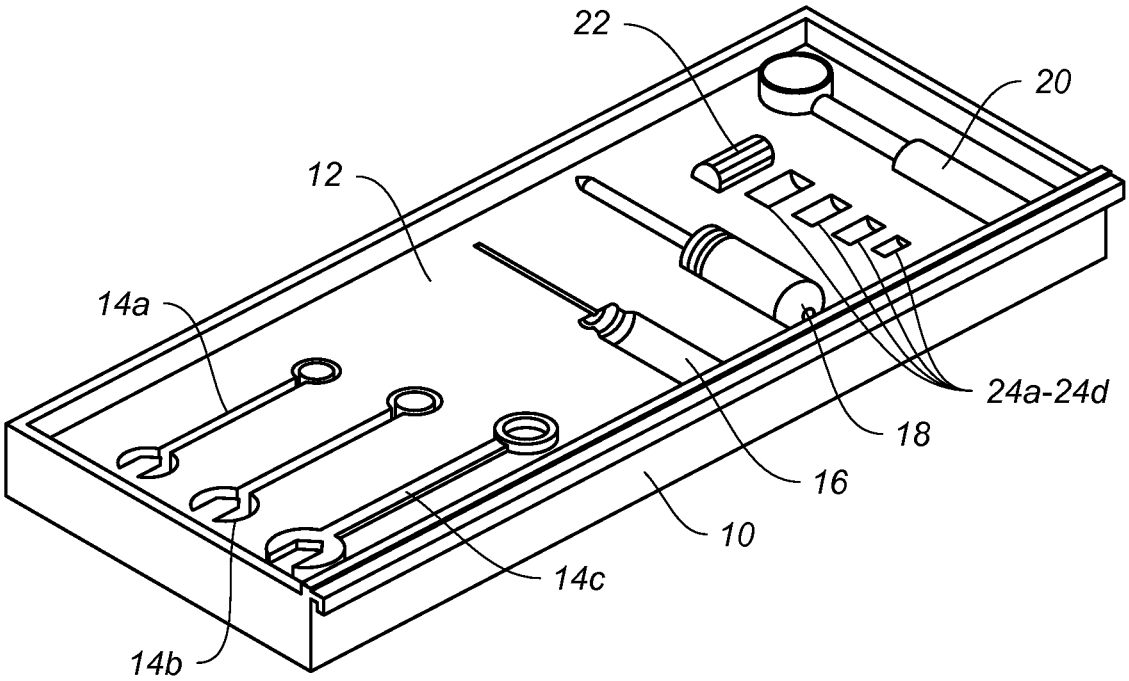
FIG. 1 (Prior Art)
FIG. 1 shows a perspective view illustrating a consolidated tool kit of the prior art.

As discussed above, the problem of misplaced objects, and in particular tools, for both homeowners and service providers have long been recognized. One way this problem has been addressed at least in the airline maintenance industry is with a Consolidated Tool Kit, or "CTK". The CTK comprises a portable tool kit having a specific list and quantity of tools contain within the kit. As illustrated in FIG. 1, an exemplary CTK may include a tray 10 with a foam insert 12 having cutout portions in the shape of the individual tools or components that belong within the kit. In the illustrated example, the foam insert 12 has cutout portions 14*a*, 14*b*, 14*c* for various sized wrenches, a cutout portion 16, 18 for screwdrivers, and cutout portions 20, 22, and 24*a*-24*d* for a socket wrench and associated components. The foam insert 12 provides both a cushion to protect the tools during transportation, as well as an easy visual means of identifying missing items. As can be seen in FIG. 1, the user can readily identify missing tools by the empty cutout portions 14*a*, 14*b*, 16, 24*a*-24*d* of the foam insert. Of course, the concept of the CTK is applicable to tools that can be contained within a single container or kit. The solution would not be readily applicable where the tools do not fit together in a single box.

Other ways of addressing the problem of misplaced tools has been with electronic monitoring devices. Several types of electronic object locator systems have been discussed above. These systems, however, have proven to be cumbersome and still suffer from setbacks. Some of the systems need to rely upon other security systems, while other locator systems require too many steps to activate the electronic object locator tags. Simpler but effective object locator systems merely signal when that object has been moved outside of a defined area. Unlike the tool locator device and system of the present invention, none of these systems provides the advantages of easily locating the object as well as providing the user with a list of what objects need to be located.

Figure 2:
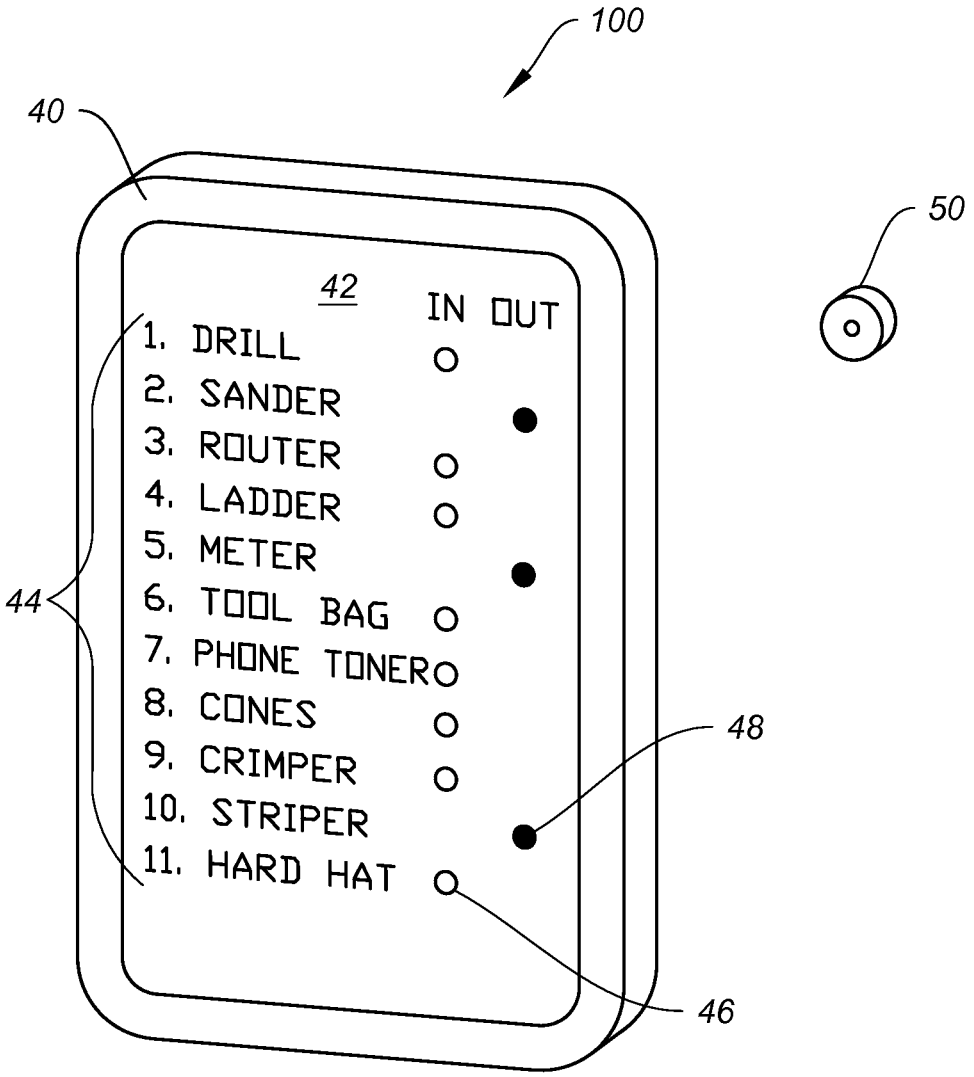
FIG. 2 shows a perspective view illustrating of a tool locator system comprising a tool locator device and associated locator tag according to an exemplary embodiment of the present invention.

Referring now to the drawings, FIG. 2 shows an exemplary embodiment of a tool locator device and system 100 of the present invention that offers a practical solution to the aforementioned challenges. The system 100 is a transmitting and receiving tracking system designed to keep an electronic inventory of the whereabouts of a variety of tools or objects, irrespective of size or shape.

The system 100 may comprise a master device 40 representing an electronic control and transmitting unit and at least one electronic tag 50 in electronic communication with the device 40. These components will now be further described.

The master device 40 serves as a user interface and provides information regarding the current status of one or more tools. The master device 40 may be hand-held, or it may be configured to be wall mounted for attachment to a wall, vehicle door, or tool panel. Alternatively, the master device 40 may be implemented as an application running on another device. For example, the master device 40 may be implemented as an application running on a smart phone, tablet, laptop computer, etc.

In one exemplary embodiment, the master device 40 may be a transmitting unit featuring a frequency generator, amplifier, internal and external antenna, and the required electrical/electronic components and circuitry. For example, the master device 40 may comprise transceiver that operates in the 2.4 GHz band or other known wireless communication bands, such as Bluetooth, Wi-Fi, etc. The master device 40 may also comprise various communication ports, such as Universal Serial Bus, Ethernet, etc.

The device 40 may be encased within a durable plastic housing, or within a metal shell, if so desired. Power to the device 40 could be accorded by a rechargeable battery source such as, for example, nickel cadmium or nickel metal hydride. The device 40 may be configured to be corded (i.e., powered by AC/DC adapter) or cordless. In one embodiment, the device 40 may be rechargeable with an electronic charger or caddy configured to hold the device 40 during the charge process.

The device 40 may be configured with a front panel 42 comprising a display that indicates the status of various tools, sets of tools, etc. The front panel 42 may be implemented using known technologies, such as a liquid crystal display (LCD) screen, a light emitting diode (LED) display, and the like. The panel 42 may be configured to display a list 44 of objects, or tools or equipment, entered into the device 40. The front panel 42 may also comprise various control buttons and the like to allow the user to navigate, for example, through a list of tools that span multiple pages, configuration menus, and etc. Alternatively, the front panel 42 may comprise a touch screen interface. In addition, the device 40 may comprise various audio/visual output features, such as LEDs, speakers, etc.

In one embodiment, the list shown on the front panel 42 may be manually entered with an alphanumeric keypad (not shown) provided on the device 40 itself. In another embodiment, the list may be entered using a computer terminal that connects to the device 40, such that the device 40 may receive (and transmit) data to the computer (not shown). For example, the master device 40 may connected to a host computer and interface an application running on the computer to configure and/or edit the list shown on the front panel 42. Various lists may be pre-formatted or provided to the master device from a variety of sources. For example, various template lists may be pre-loaded on the master device 40 or downloaded from an external source, such as the Internet, a memory card, etc.

The tags 50 are attached or included with the tools tracked by the master device 50. The tags 50 may employ various systems, such as magnetic systems, acousto-magnetic, radio-frequencies, and/or microwaves, alone or in combination. The tags 50 may be active or passive devices. In one embodiment, the corresponding receivers, or electronic receiver tags 50, may consist of small, circular shaped electronic units, as shown in FIG. 2. Of course, it is understood that the tags 50 may be configured with other shapes, such as square, rectangular, or flat bars. In one embodiment, the tags 50 may be approximately the size of a watch battery. These tags 50 may be configured as electronic receiver units and comprise a tuned frequency and receiver circuit enclosed within its housing. As shown, only one tag 50 is illustrated. However, it is understood that the system 100 may employ any number of tags 50, such as for example, six (6) to twelve (12) or more, as is desired. Alternatively, the tags 50 may be pre-installed or pre-attached to various tools that are to be tracked by system 100. In some embodiments, the master device 40 may provide a training mode to recognize tags 50 that have been attached to a particular tool.

The tags 50 may be configured to uniquely identify a particular tool to varying degrees. For example, the tag 50 may provide a unique identifier for a single tool, a group of tools, etc. The tag 50 may also be configured to provide other information, such as owner information, location information, time/date stamps, etc. Furthermore, the tags 50 may be used to track groups of tools rather than individual tools. For example, a tag 50 may be attached to a CTK or other toolbox, which is then tracked collectively by the master device 40. Thus, the embodiments allow any number of tools or groups of tools to be tracked and inventoried individually or collectively.

Figure 3:
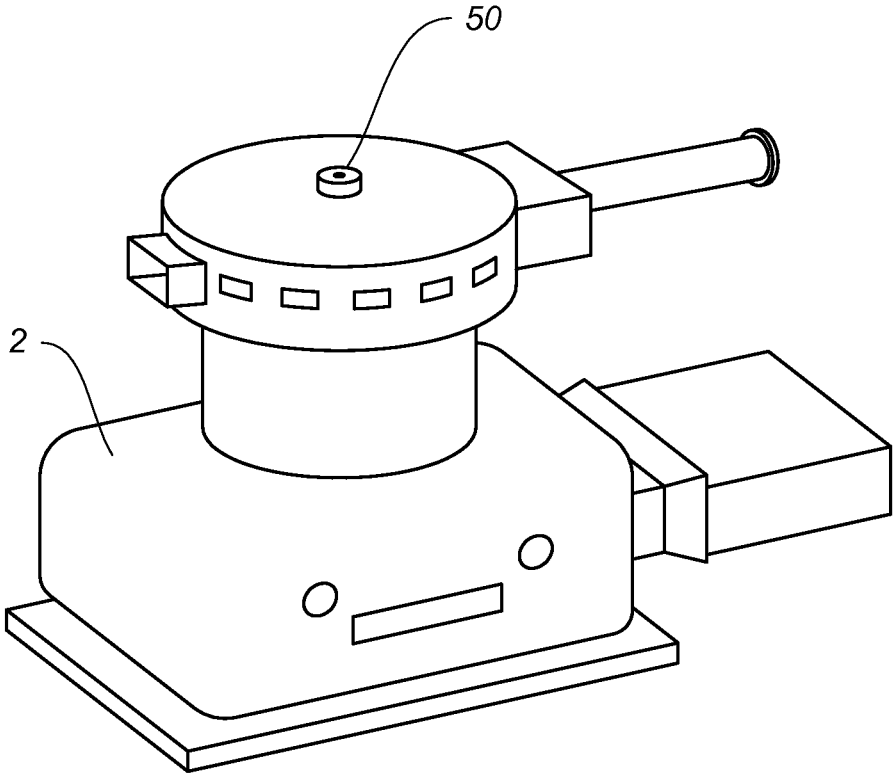
FIG. 3 is a perspective view illustrating the locator tag in use with a tool according to an exemplary embodiment of the present invention.

The receiver tags 50 may be attached to the desired object or tool in any number of ways. For example, the tags 50 may be attached to a tool, such as for example a sander 2 listed in FIG. 2 and shown in FIG. 3, using Velcro, a durable adhesive such as glue or tape, or a strong magnet. The attachment may be permanent, such as by welding the receiver tag 50 to the tool, or temporary to allow the user to remove the tag 50 and reuse it on other tools. As noted, in some embodiments, the tag 50 may be pre-attached or pre-installed on the tool.

The master device 40 may be configured with electronic circuitry to serve as a radiofrequency (RF) transmitter unit, such as 2.4 GHz signals, that are encoded and/or encrypted. For example, in one embodiment, during operation, the transmitter in the master device 40 may transmit a plurality of coded RF signals, each signal being detectable by one of the receiver tags 50. Thus, each receiver tag 50 receives a unique RF signal from the transmitter unit. Activation buttons (not shown) may be provided on either the front panel 42 of the device 40, or along the side of the device 40. In one embodiment, as noted, the display 42 may be a touch screen and eliminate the need for buttons. In such a case, the user could simply touch the screen and enter the necessary information for the list 44 of tools to track, as well as activate the system 100 to generate and receive the signals.

In use, the master device 40 serves as a user interface device, and can be programmed with a list 44 of the desired tools, equipment, machinery, accessories, etc. for a particular purpose. In the exemplary embodiment shown in FIG. 2, the list of tools or accessories to be inventoried and tracked include: a drill, a sander, a router, a ladder, a meter, a tool bag, a phone toner, cones, a crimper, a striper, and a hard hat. Of course, it is understood that an assortment of other tools or equipment may be listed, depending on the particular service to be provided. It should be noted that, due to the flexibility of system 100, the list 44 represented in FIG. 2 comprises items that would not normally be provided as either a set, or transported together in a single toolbox, such as for example, a ladder, cones, and hard hat.

As shown, next to each item of the list 44 may appear a series of visual cues, such as LED lights 46, 48. These lights may be provided in different colors, such that light 46 may be green, and light 48 may be red, as an example. When the device 40 is activated, the device will transmit signals to the corresponding receiver tags 50 that have been placed onto the tools of the list 44. Those receiver tags 50 within a predefined distance from the device 40 would return a signal to the master device 40, and display as a green light 46 next to the corresponding tool on the list 44. Those receiver tags 50 outside of the predefined distance from the master device 40 would not return a signal, and hence display as a red light 48 next to that corresponding tool. Accordingly, the system 100 provides an easy way to visually determine if tools are misplaced, missing, or forgotten. More importantly, the display of the list 44 on the master device 40 also provides the user with an electronic inventory list of the items that need to be brought to a repair job.

In one embodiment, the lights 46, 48 may be configured to flash intermittently or display a relative degree of brightness or light, in order to indicate strength or relative proximity to the master device 40. For example, the red light 48 signal may be configured to flash red when the receiver tag 50 and corresponding tool is within 10-20 feet of the master device, while the red light signal 48 may remain lit when the receiver tag and corresponding tool is outside of the 20 feet perimeter from the master device. In another example, the red light signal 48 may be much brighter when the receiver tag and corresponding tool is outside of the 20 feet perimeter, and less bright within 10-20 feet. Of course, this is merely exemplary and the system 100 may be configured for other distance parameters.

In another embodiment, the lights 46, 48 may work in conjunction with an audible signal such that a single beep or a series of intermittent beeps can be used to track the receiver tag 50 and corresponding tool. The audible signal may be louder the farther away the receiver tag 50 and corresponding tool is from the master device, for example. As with the visual cues, the audible signal could be provided as a single, continuous signal, or a series of intermittent signals, with the duration, frequency, and strength customizable to the user's preference.

This system 100 provides an advantage over the prior art systems in that the user does not have to perform multiple steps to determine what tools are actually missing, before looking for the tool. By viewing the display, the user can readily determine what tools are needed, and what tools are present or absent. Other systems of the prior art require the user to know what item to look for before activating the locator system. For example, other prior art systems are effective when the user recognizes that a tool, such as a drill, is missing. The user then activates the prior art locator system to find that drill. But those systems of the prior art do not easily allow the user to recognize that the drill is missing in the first place. The present system 100 provides the user an electronic inventory list of the tools with which to track all the tools as a whole, rather than a system that tracks individual tools one at a time. Thus, in the present system 100, the user can activate the system and know immediately which tool is missing from a collection of tools, and maintain all those tools within the collection at once.

The system 100 of the present invention also provides the advantage of allowing the user to customize the system 100 to track any set of objects or tools. This can easily be accomplished using a provided keypad or through a computer link to the master device 40. The user may name the tools or objects however desired. In addition, the receiver tags 50 are configured to attach to any surface, thereby enabling them to be used on a variety of tools and equipment. Thus, the system 100 is highly customizable and reusable for different repair jobs. The system 100 also gives the user a convenient checklist of the necessary tools to bring to a repair job, thus ensuring that the user is fully prepared upon arriving at the job.

As a back up, an additional transmitter unit or device 40 could also be used in conjunction with this system 100. This additional device 40 could be stored in one's vehicle, as an extra precaution and an added measure to ensure all tools are present.

The system 100 of the present invention would effectively assist consumers and professionals in quickly checking the inventory of their tools. Eliminating the need to check and recheck, wondering if the tool has been accounted for, the present system 100 would assist in taking inventory of such tools automatically. As a result, the user could gather their tools, view the receiver and be immediately aware that a tool is missing or out of range. As a result, expensive and oftentimes irreplaceable tools would not be inadvertently left behind.

Use of the system 100 would eliminate costly replacement of lost tools, as well as the embarrassment of leaving a needed implement behind. Easy to operate, the simple pressing of a few buttons or activation keys would store a plethora of tool names within the electronic receiver or master device 40. Additionally, the clear red and green visual indicators 46, 48 would display the precise status of any tool input into the system 100. The system's simplicity makes this product very ideal for use by anyone, regardless of technical acumen. In addition to tools, the versatile collection of receiver tags 50 could be easily affixed to personal and household items such as purses, keys, remote control units, medications, and even toys. The system 100 is therefore useful for providing an electronic inventory list and for tracking items within the list of objects other than tools.

Other embodiments of the disclosure will be apparent to those skilled in the art from consideration of the specification and practice of the disclosure provided herein. It is intended that the specification and examples be considered as exemplary only.

What is claimed is:

1. An object locator system comprising: a transmitter device comprising an electronic control circuit for producing control signals, the transmitter device having a panel display for viewing a list of objects to be tracked; and one or more receiver tags comprising an electronic circuit for receiving the control signals from the transmitter device, and for transmitting a response signal to the transmitter device, each one of the one or more receiver tags being attachable to an object from the list; wherein the transmitter device provides a first visual or audible signal when at least one of the objects of the list is within a first predetermined distance from the transmitter device, wherein the transmitter device provides a second visual or audible signal when the at least one of the objects of the list is between the first predetermined distance and a second predetermined distance from the transmitter device, and wherein the transmitter device provides a third visual or audible signal when the at least one of the objects of the list is outside the second predetermined distance from the transmitter device; wherein the first visual or audible signal comprises a first light that is configured to flash when the at least one of the objects of the list is within the first predetermined distance from the transmitter device, wherein the first light configured to remain lit when the at least one of the objects of the list is between the first predetermined distance and the second predetermined distance from the transmitter device, and wherein the third visual or audible signal comprises a second light that is configured to flash or remain lit when the at least one of the objects of the list is outside the second predetermined distance from the transmitter device; wherein each of the objects of the list has a different first light and a different second light.

2. The system of claim 1, wherein the control signals are radiofrequency signals.

3. The system of claim 1, wherein the transmitter device includes a keypad for entry of the objects of the list.

4. The system of claim 1, wherein the transmitter device includes activation buttons to initiate transmission of the signals.

5. The system of claim 1, wherein the transmitter device has a touch panel display.

6. The system of claim 1, wherein the visual signals are configured to vary in color, intensity and duration.

7. The system of claim 1, wherein the audible signals are configured to vary in intensity and duration.

8. The system of claim 1, wherein the receiver tags are configured for attachment to the objects with a Velcro fastener, glue, tape, adhesive, or a magnet.

9. The system of claim 1, wherein the transmitter device is hand-held.

10. The system of claim 1, wherein the transmitter device is wall-mounted.

11. The system of claim 1, wherein the receiver tags are removable and reusable.

12. The system of claim 1, wherein the transmitter device receives data from a computer electronically linked to the device.

13. The system of claim 1, wherein the transmitter device is rechargeable.

14. The system of claim 1, wherein the transmitter device is powered with an AC/DC adapter.

15. The system of claim 1, wherein the panel display shows a predetermined list of objects to be tracked for a particular job.

16. The system of claim 15, wherein the predetermined list of objects is different for a first job than for a second job.

17. The system of claim 1, The system of claim 1, wherein the first visual or audible signal comprises a first light that is configured to have a first brightness when the at least one of the objects of the list is within the first predetermined distance from the transmitter device, wherein the first light configured to have a second, different brightness when the at least one of the objects of the list is between the first predetermined distance and the second predetermined distance from the transmitter device, and wherein the third visual or audible signal comprises a second light that is configured to flash or remain lit when the at least one of the objects of the list is outside the second predetermined distance from the transmitter device.

* * * * *